US011348459B2

(12) United States Patent
Kibayashi et al.

(10) Patent No.: US 11,348,459 B2
(45) Date of Patent: May 31, 2022

(54) INFORMATION PROVIDING DEVICE, MOVABLE BODY, AND METHOD OF PROVIDING INFORMATION

(71) Applicant: HONDA MOTOR CO., LTD., Tokyo (JP)

(72) Inventors: Takeshi Kibayashi, Wako (JP); Yoshinori Kinoshita, Wako (JP); Takayuki Kishi, Wako (JP); Hironori Aoyagi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/199,866

(22) Filed: Mar. 12, 2021

(65) Prior Publication Data

US 2021/0287535 A1 Sep. 16, 2021

(30) Foreign Application Priority Data

Mar. 16, 2020 (JP) ..... JP2020-044974

(51) Int. Cl.
*G08G 1/0962* (2006.01)

(52) U.S. Cl.
CPC ..... *G08G 1/0962* (2013.01)

(58) Field of Classification Search
CPC ..... G08G 1/0962; G08G 1/087; G08G 1/095
See application file for complete search history.

(56) References Cited

U.S. PATENT DOCUMENTS

2005/0140523 A1* 6/2005 Publicover ..... G08G 1/095 340/901
2008/0012726 A1* 1/2008 Publicover ..... G08G 1/096725 340/932
2008/0266072 A1* 10/2008 Suzuki ..... G08G 1/0962 340/438
2011/0098898 A1* 4/2011 Stahlin ..... B60W 30/18154 701/1
2018/0154870 A1* 6/2018 Kurata ..... B60T 7/12
2020/0242924 A1* 7/2020 Publicover ..... G08G 1/087

FOREIGN PATENT DOCUMENTS

JP 2009-104543 A 5/2009

* cited by examiner

*Primary Examiner* — Hoi C Lau
(74) *Attorney, Agent, or Firm* — Carrier Blackman & Associates, P.C.; Joseph P. Carrier; William D. Blackman

(57) ABSTRACT

An information providing device is equipped with an information providing control unit that, in the case that a provision starting condition for starting to provide recommended stopping information is satisfied by a current indication of a traffic signal and a travel state, initiates the provision of the recommended stopping information, whereas in the case that a provision termination condition for stopping to provide the recommended stopping information is satisfied, terminates the provision of the recommended stopping information. After the provision of the recommended stopping information is initiated by having satisfied the provision starting condition, in the case that the provision of the recommended stopping information is terminated by having satisfied the provision termination condition, and further thereafter, the provision starting condition is satisfied again, the information providing control unit restricts re-providing of the recommended stopping information.

8 Claims, 5 Drawing Sheets

INFORMATION PROVIDING DEVICE, MOVABLE BODY, AND METHOD OF PROVIDING INFORMATION

CROSS-REFERENCE TO RELATED APPLICATION

This application is based upon and claims the benefit of priority from Japanese Patent Application No. 2020-044974 filed on Mar. 16, 2020, the contents of which are incorporated herein by reference.

BACKGROUND OF THE INVENTION

Field of the Invention

The present invention relates to an information providing device, a movable body, and a method of providing information.

Description of the Related Art

In Japanese Laid-Open Patent Publication No. 2009-104543, an information providing device is disclosed that outputs driving assist information including dangerous traveling regions.

SUMMARY OF THE INVENTION

However, in Japanese Laid-Open Patent Publication No. 2009-104543, the information cannot always accurately be provided.

An object of the present invention is to provide an information providing device, a movable body, and a method of providing information, which are capable of accurately providing recommended stopping information.

An information providing device according to one aspect of the present invention includes an external environment recognition unit configured to recognize an external environment of a movable body, a travel state determination unit configured to determine a travel state of the movable body, and an information providing control unit configured to, in the case that a provision starting condition for starting to provide recommended stopping information is satisfied by a current indication of a traffic signal recognized by the external environment recognition unit, and the travel state determined by the travel state determination unit, initiate the provision of the recommended stopping information, and also configured to, in the case that a provision termination condition for stopping to provide the recommended stopping information is satisfied, terminate the provision of the recommended stopping information, wherein, after the provision of the recommended stopping information is initiated by having satisfied the provision starting condition, in the case that the provision of the recommended stopping information is terminated by having satisfied the provision termination condition, and further thereafter, the provision starting condition is satisfied again, the information providing control unit restricts re-providing of the recommended stopping information.

A movable body according to another aspect of the present invention includes the above-described information providing device.

A method of providing information according to another aspect of the present invention includes a step of initiating a provision of recommended stopping information, in the case that a provision starting condition for starting to provide the recommended stopping information is satisfied by a current indication of a traffic signal and a travel state of a movable body, and a step of terminating the provision of the recommended stopping information, in the case that a provision termination condition for stopping to provide the recommended stopping information is satisfied, wherein, after the provision of the recommended stopping information is initiated by having satisfied the provision starting condition, in the case that the provision of the recommended stopping information is terminated by having satisfied the provision termination condition, and further thereafter, the provision starting condition is satisfied again, re-providing of the recommended stopping information is restricted.

According to the present invention, an information providing device, a movable body, and a method of providing information can be provided, which are capable of accurately providing recommended stopping information.

The above and other objects, features, and advantages of the present invention will become more apparent from the following description when taken in conjunction with the accompanying drawings, in which preferred embodiments of the present invention are shown by way of illustrative example.

DETAILED DESCRIPTION OF THE PREFERRED EMBODIMENTS

Preferred embodiments of an information providing device, a movable body, and a method of providing information according to the present invention will be presented and described in detail below with reference to the accompanying drawings.

Embodiment

Figure 1:
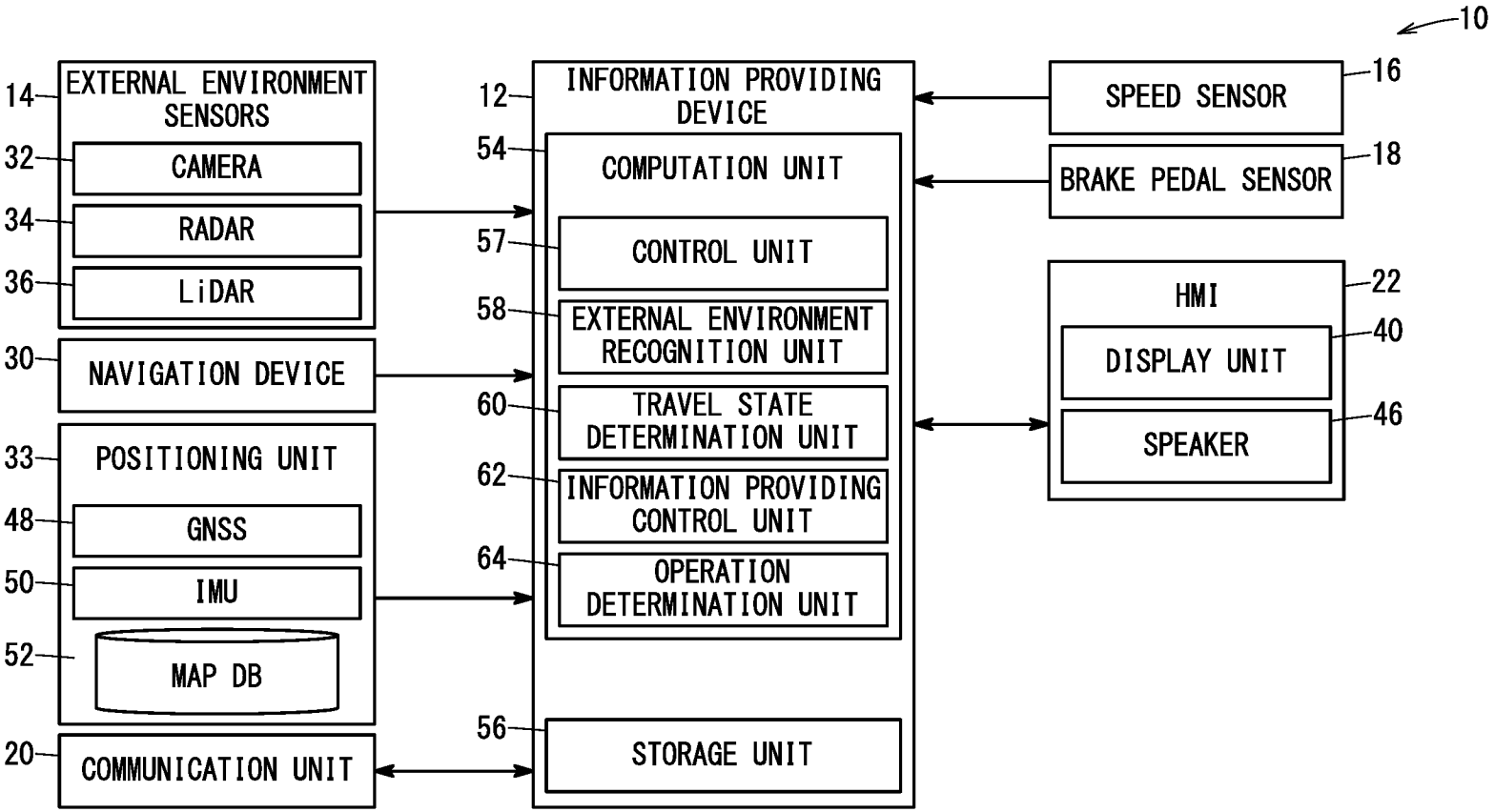
FIG. 1 is a block diagram showing a movable body equipped with an information providing device according to an embodiment.

An information providing device, a movable body, and a method of providing information according to one embodiment will be described with reference to the drawings. FIG. 1 is a block diagram showing a movable body equipped with an information providing device according to a present embodiment. In this instance, although an exemplary case will be described in which the movable body 10 is a vehicle, the movable body 10 is not limited to being a vehicle. For example, the movable body 10 may be a robot or the like.

The movable body 10 is equipped with an information providing device 12, namely, an information providing control ECU (Electronic Control Unit). The movable body 10 is further equipped with external environment sensors 14, a speed sensor 16, a brake pedal sensor 18, a communication unit 20, an HMI (Human Machine Interface) 22, a navigation device 30, and a positioning unit 33. Although the movable body 10 is equipped with other constituent elements apart from those noted above, description of such elements is omitted herein.

The external environment sensors 14 acquire external environmental information, and more specifically, information concerning the external environment around the movable body 10. The external environment sensors 14 include a plurality of cameras 32 and a plurality of radar devices 34. Among the external environment sensors 14, there are further included a plurality of LiDAR (Light Detection and Ranging, Laser Imaging Detection and Ranging) devices 36.

Information acquired by cameras (imaging units) 32, i.e., camera information, is supplied from the cameras 32 to the information providing device 12. As such camera information, there may be cited captured image information and the like. The camera information, together with radar information and LiDAR information to be described later, makes up the external environmental information. Although a single camera 32 is illustrated in FIG. 1, a plurality of cameras 32 are actually provided.

The radar devices 34 emit transmitted waves toward the exterior of the movable body 10, and receive reflected waves that are reflected and returned by detected objects. As examples of the transmitted waves, there may be cited electromagnetic waves. As examples of the electromagnetic waves, there may be cited millimeter waves. The radar devices 34 generate radar information (reflected wave signals) based on the reflected waves or the like. The radar devices 34 supply the generated radar information to the information providing device 12. Although one radar device 34 is illustrated in FIG. 1, a plurality of radar devices 34 are actually provided in the movable body 10. Moreover, the radar devices 34 are not limited to using millimeter wave radar. For example, laser radar devices, or ultrasonic sensors or the like may be used as the radar devices 34.

The LiDAR devices 36 continuously irradiate lasers in all directions of the movable body 10, measure the three-dimensional positions of reflection points based on reflected waves of the emitted lasers, and output information, i.e., three-dimensional information, in relation to the three-dimensional positions. The LiDAR devices 36 supply the three-dimensional information, i.e., LiDAR information, to the information providing device 12. Although one LiDAR device 36 is illustrated in FIG. 1, a plurality of LiDAR devices 36 are actually provided in the movable body 10.

The speed sensor 16 can detect the speed, and in particular a vehicle speed, of the movable body 10. The information detected by the speed sensor 16, and specifically, information indicating the speed of the movable body 10, can be supplied to an information providing control unit 62.

The brake pedal sensor 18 detects an operated amount of a non-illustrated brake pedal. The information detected by the brake pedal sensor 18, namely, information indicating an operated amount of the brake pedal, can be supplied to an operation determination unit 64.

The communication unit 20 performs wireless communications with non-illustrated external equipment. The external equipment may include, for example, a non-illustrated external server.

The HMI 22 receives an operation input made by an occupant, and provides various types of information to the occupant in a visual, audible, or tactile manner. The HMI 22 may include, for example, a display unit 40, and a speaker 46.

The display unit 40 is capable of displaying predetermined information. As the display unit 40, there can be used, for example, a liquid crystal display, an organic EL display, or the like, however, the display unit 40 is not limited to such displays. Further, the display unit 40 may be equipped, for example, with a touch panel, although the display unit 40 is not limited to this feature. Recommended stopping information and the like, which will be described later, can be displayed on the display unit 40.

The speaker 46 serves to provide various types of information to the occupant by way of sound or voice. The speaker 46 may provide the later-described recommended stopping information or the like to the occupant by way of voice.

The navigation device 30 is equipped with a non-illustrated GNSS (Global Navigation Satellite System) sensor. In addition, the navigation device 30 is further equipped with a non-illustrated computation unit and a non-illustrated storage unit. The GNSS sensor detects the current position of the movable body 10. From a map database stored in the storage unit, the computation unit reads out map information corresponding to the current position detected by the GNSS sensor. Using the map information, the computation unit determines a target route from the current position to a destination. The destination is input by the occupant via the HMI 22. As noted above, the display unit 40 may be equipped with a touch panel. Input of the destination may be carried out by the touch panel being operated by the occupant. The navigation device 30 is capable of outputting a created target route to the information providing device 12. The information providing device 12 can supply the target route to the HMI 22. The HMI 22 may display the target route on the display unit 40.

The positioning unit 33 is equipped with a GNSS 48. The positioning unit 33 is further equipped with an IMU (Inertial Measurement Unit) 50 and a map database (map DB) 52. The positioning unit 33 specifies the position of the movable body 10 by appropriately using the information obtained by the GNSS 48, the information obtained by the IMU 50, and the map information stored in the map database 52. The positioning unit 33 is capable of supplying self-identifying position information, or stated otherwise, position information of the movable body 10, which is information indicative of the position of the movable body 10, with respect to the information providing device 12. Further, the positioning unit 33 is capable of supplying the map information with respect to the information providing device 12.

The information providing device 12 is equipped with a computation unit 54 and a storage unit 56. The computation unit 54 governs the overall control of the information providing device 12. The computation unit 54, for example, can be constituted by at least one processor. As such a processor, there may be used, for example, a CPU (Central Processing Unit) or the like. The computation unit 54 executes an information providing control by controlling each of the respective units based on programs stored in the storage unit 56.

The computation unit 54 is equipped with a control unit 57, an external environment recognition unit 58, a travel state determination unit 60, an information providing control unit 62, and an operation determination unit 64. The control unit 57, the external environment recognition unit 58, the travel state determination unit 60, the information providing control unit 62, and the operation determination unit 64 can be realized by programs, which are stored in the storage unit 56, being executed by the computation unit 54.

The storage unit 56 includes a non-illustrated volatile memory, and a non-illustrated nonvolatile memory. As an example of the volatile memory, there may be cited a RAM (Random Access Memory). As an example of the nonvolatile memory, there may be cited a ROM (Read Only Memory), a flash memory, or the like. The external environmental information, the vehicle body behavior information, and the driving operation information, etc., are stored, for example, in the volatile memory. Programs, tables, maps, and the like are stored, for example, in the nonvolatile memory.

The control unit 57 governs the overall control of the information providing device 12.

Figure 2:
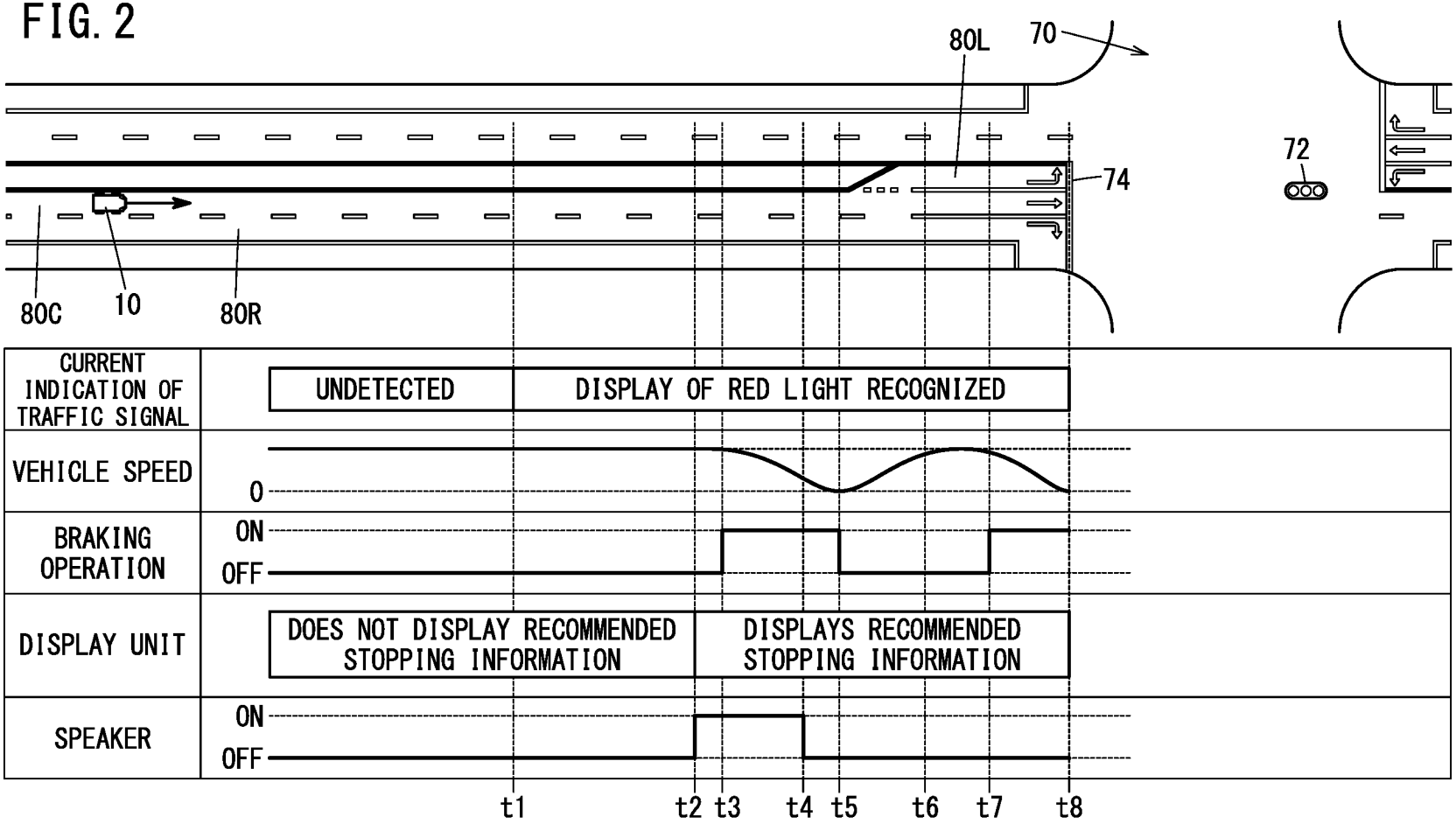
FIG. 2 is a view showing an example of operations of the information providing device according to an embodiment.

The external environment recognition unit 58 is capable of recognizing the external environmental situation of the movable body 10. The external environment recognition unit 58 can recognize the external environmental situation, based on external environmental information supplied from the external environment sensors 14 or the like, and more specifically, the external environmental information supplied from the camera 32. FIG. 2 is a view showing an example of operations of the information providing device according to the present embodiment. An example of the travel lane is shown on the upper side of FIG. 2. A time chart is shown on the lower side of FIG. 2. An exemplary case in which an intersection 70 is positioned in a travel direction of the movable body 10 is shown in FIG. 2. A traffic signal 72 belonging to the intersection 70, and a stop line 74 corresponding to the traffic signal 72 are further shown in FIG. 2. An exemplary case in which the movable body 10 is traveling in a lane 80C is shown in FIG. 2. A lane 80R for turning to the right is provided on one side of the lane 80C, and more specifically, on the right side in the travel direction of the lane 80C. A lane 80L for turning to the left is provided on another side of the lane 80C, and more specifically, on the left side in the travel direction of the lane 80C. The external environment recognition unit 58 is capable of recognizing a position of the intersection 70, a position of the traffic signal 72, a current indication of the traffic signal 72, a position of the stop line 74 corresponding to the traffic signal 72, etc., based on the external environmental information supplied from the external environment sensors 14 and the like. Moreover, the external environment recognition unit 58 may recognize the aforementioned features, on the basis of information supplied from the navigation device 30, the communication unit 20, and the like.

The travel state determination unit 60 is capable of determining the travel state of the movable body 10. More specifically, based on the information supplied from the speed sensor 16 and the like, the travel state determination unit 60 is capable of determining the travel state of the movable body 10.

The information providing control unit 62 is capable of providing recommended stopping information based on the current indication or the like of the traffic signal 72 recognized by the external environment recognition unit 58. The information providing control unit 62 can start to provide the recommended stopping information, in the case that a provision starting condition (which will be described below) for starting to provide the recommended stopping information is satisfied. More specifically, in the case that the following provision starting condition is satisfied by a current indication of the traffic signal 72 recognized by the external environment recognition unit 58, and the travel state of the movable body 10 determined by the travel state determination unit 60, the information providing control unit 62 may start to provide the recommended stopping information.

The provision starting condition is a condition in which the current indication of the traffic signal 72 recognized by the external environment recognition unit 58 is an indication to stop, and the speed of the movable body 10 determined by the travel state determination unit 60 is greater than or equal to a first speed threshold value TH1. The first speed threshold value TH1 is a speed value in order to cause the movable body 10 to reliably stop in front of the stop line 74 corresponding to the traffic signal 72 that is currently displaying an indication to stop. The first speed threshold value TH1 can be set in a manner so that the movable body 10 is capable of stopping in front of the stop line 74, even in the case that the movable body 10 is decelerated at a deceleration lying within a range that does not exceed a predetermined deceleration limit value. The concerned deceleration limit value may be, for example, 0.4 G, however the present invention is not limited to this feature. The first speed threshold value TH1 may vary depending on the distance from the current position of the movable body 10 to the stop line 74, and the current speed of the movable body 10.

The information providing control unit 62 can stop providing the recommended stopping information, in the case that a provision termination condition for stopping to provide the recommended stopping information is satisfied. The provision termination condition is a condition in which the speed of the movable body 10 determined by the travel state determination unit 60 is less than a second speed threshold value TH2 which is lower than the first speed threshold value TH1. The second speed threshold value TH2 is a speed value for determining whether or not the speed of the movable body 10 has sufficiently decreased. The second speed threshold value TH2 can be set in a manner so that it is possible to accurately determine whether the speed of the movable body 10 has sufficiently decreased.

After the provision of the recommended stopping information is initiated, in the case that the provision of the recommended stopping information is terminated due to having satisfied the provision termination condition, and further thereafter, the provision starting condition is satisfied again, the information providing control unit 62 can restrict the re-providing of the recommended stopping information. In such a case, re-providing of the recommended stopping information is restricted for the following reason. After the provision of the recommended stopping information is initiated, in the case that the recommended stopping information is terminated due to the provision termination condition having been satisfied, there is a high possibility that the occupant is already aware that the traffic signal 72 is currently displaying an indication to stop. In the case that, even though the occupant is already aware that the traffic signal 72 is currently displaying an indication to stop, the recommended stopping information is re-provided due to the provision starting condition being satisfied again, the occupant may find it annoying. For this reason, according to the present embodiment, after the provision of the recommended stopping information is initiated, in the case that the provision of the recommended stopping information is terminated due to having satisfied the provision termination condition, and further thereafter, the provision starting condition is satisfied again, re-providing of the recommended stopping information is restricted.

The information providing control unit 62 can perform control in a manner so that the recommended stopping information is displayed on the display unit 40. Further, the information providing control unit 62 may provide the recommended stopping information using the speaker 46.

The information providing control unit 62 restricts the re-providing of the recommended stopping information using the speaker 46, while on the other hand, continues to provide the recommended stopping information using the display unit 40 even when the provision termination condition is satisfied.

The operation determination unit 64 can determine whether or not a braking operation has been performed by the occupant of the movable body 10. Based on information supplied from the brake pedal sensor 18, the operation determination unit 64 can determine the presence or absence of the braking operation by the occupant of the movable body 10.

Figure 3:
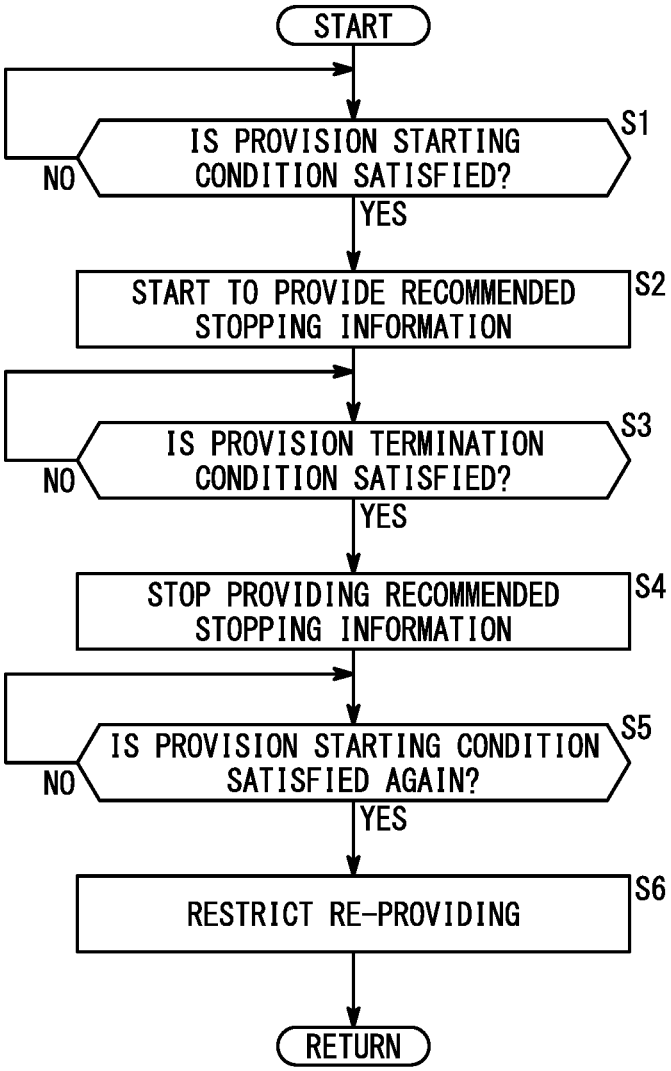
FIG. 3 is a flowchart showing an example of operations of the information providing device according to an embodiment.

FIG. 3 is a flowchart showing an example of operations of the information providing device according to the present embodiment.

In step S1, the information providing control unit 62 determines whether or not the provision starting condition has been satisfied. In the case that the provision starting condition is satisfied (YES in step S1), the process transitions to step S2. In the case that the provision starting condition is not satisfied (NO in step S1), step S1 is repeated.

In step S2, the information providing control unit 62 starts to provide the recommended stopping information. More specifically, display of the recommended stopping information on the display unit 40 is initiated, and provision of the recommended stopping information using the speaker 46 is initiated. Thereafter, the process transitions to step S3.

In step S3, the information providing control unit 62 determines whether or not the provision termination condition has been satisfied. In the case that the provision termination condition is satisfied (YES in step S3), the process transitions to step S4. In the case that the provision termination condition is not satisfied (NO in step S3), step S3 is repeated.

In step S4, the information providing control unit 62 stops providing the recommended stopping information. More specifically, the provision of the recommended stopping information using the speaker 46 is terminated. On the other hand, the display of the recommended stopping information on the display unit 40 can be continued. Thereafter, the process transitions to step S5.

In step S5, the information providing control unit 62 determines whether or not the provision starting condition has been satisfied again. In the case that the provision starting condition is satisfied again (YES in step S5), the process transitions to step S6. In the case that the provision starting condition is not satisfied again (NO in step S5), step S5 is repeated.

In step S6, the information providing control unit 62 restricts the re-providing of the recommended stopping information. More specifically, re-providing of the recommended stopping information using the speaker 46 is restricted. On the other hand, the display of the recommended stopping information on the display unit 40 can be continued. In the foregoing manner, the process shown in FIG. 3 is carried out.

Operations of the information providing device according to the present embodiment will be described with reference to FIG. 2.

At time t1, it is recognized by the external environment recognition unit 58 that the traffic signal 72 is currently displaying a red light.

At time t2, the travel state determination unit 60 determines that the speed of the movable body 10 is greater than or equal to the first speed threshold value TH1. Since the provision starting condition for starting to provide the recommended stopping information is satisfied at time t1, the information providing control unit 62 initiates the provision of the recommended stopping information. More specifically, the recommended stopping information is displayed on the display unit 40, together with providing the recommended stopping information using the speaker 46.

At time t3, the braking operation is started by the occupant. Consequently, the speed of the movable body 10 decreases.

At time t4, the travel state determination unit 60 determines that the speed of the movable body 10 has become less than the second speed threshold value TH2. Since the provision termination condition for stopping to provide the recommended stopping information is satisfied, the information providing control unit 62 stops providing the recommended stopping information. More specifically, the provision of the recommended stopping information using the speaker 46 is terminated. The display of the recommended stopping information on the display unit 40 can be maintained as it is, although the present invention is not limited to this feature.

At time t5, the braking operation by the occupant is completed. Thereafter, the speed of the movable body 10 increases.

At time t6, the travel state determination unit 60 determines that the speed of the movable body 10 is greater than or equal to the first speed threshold value TH1. Consequently, the provision starting condition for starting to provide the recommended stopping information is satisfied again. The information providing control unit 62 restricts the re-providing of the recommended stopping information. More specifically, the information providing control unit 62 restricts the re-providing of the recommended stopping information using the speaker 46. Moreover, the display of the recommended stopping information on the display unit 40 can be maintained as it is, although the present invention is not limited to this feature.

At time t7, the braking operation is started by the occupant. Consequently, the speed of the movable body 10 decreases.

At time t8, the movable body 10 comes to a stop in front of the stop line 74.

In the foregoing manner, according to the present invention, in the case that the provision starting condition for starting to provide the recommended stopping information is satisfied by the current indication of the traffic signal 72 and the travel state of the movable body 10, the provision of the recommended stopping information is initiated. After the provision of the recommended stopping information is initiated, in the case that the provision of the recommended stopping information is terminated due to having satisfied the provision termination condition, and further thereafter, the provision starting condition is satisfied again, re-providing of the recommended stopping information is restricted. More specifically, according to the present embodiment, since the re-provision of the recommended stopping information is restricted, it is possible to prevent a situation in which the occupant is made to feel irritated. In this manner, according to the present embodiment, the information providing device 12 can be provided which is capable of accurately providing the recommended stopping information.

(First Modification)

An information providing device, a movable body, and an information providing method according to a first modification of the present embodiment will be described with reference to the drawings.

According to the present modification, in the case that the braking operation corresponding to the provision of the recommended stopping information is not performed by the occupant after the provision of the recommended stopping information has been started, the information providing control unit 62 does not restrict the re-providing of the recommended stopping information. More specifically, in a state in which the braking operation corresponding to the provision of the recommended stopping information is not performed by the occupant, in the case that the provision of the recommended stopping information is terminated, and thereafter, the provision starting condition is satisfied again, the information providing control unit 62 re-provides the recommended stopping information. In the case that, after provision of the recommended stopping information has been started, the braking operation corresponding to the provision of the recommended stopping information is not performed by the occupant, the re-providing of the recommended stopping information is not restricted for the following reason. That is, in the case that the braking operation corresponding to the provision of the recommended stopping information is not performed by the occupant, a possibility exists that the occupant does not recognize that the traffic signal 72 is currently displaying an indication to stop. Accordingly, in such a case, it is preferable to re-provide the recommended stopping information. For this reason, according to the present modification, in the case that, after provision of the recommended stopping information has been started, the braking operation corresponding to the provision of the recommended stopping information is not performed by the occupant, re-providing of the recommended stopping information is carried out.

Figure 4:
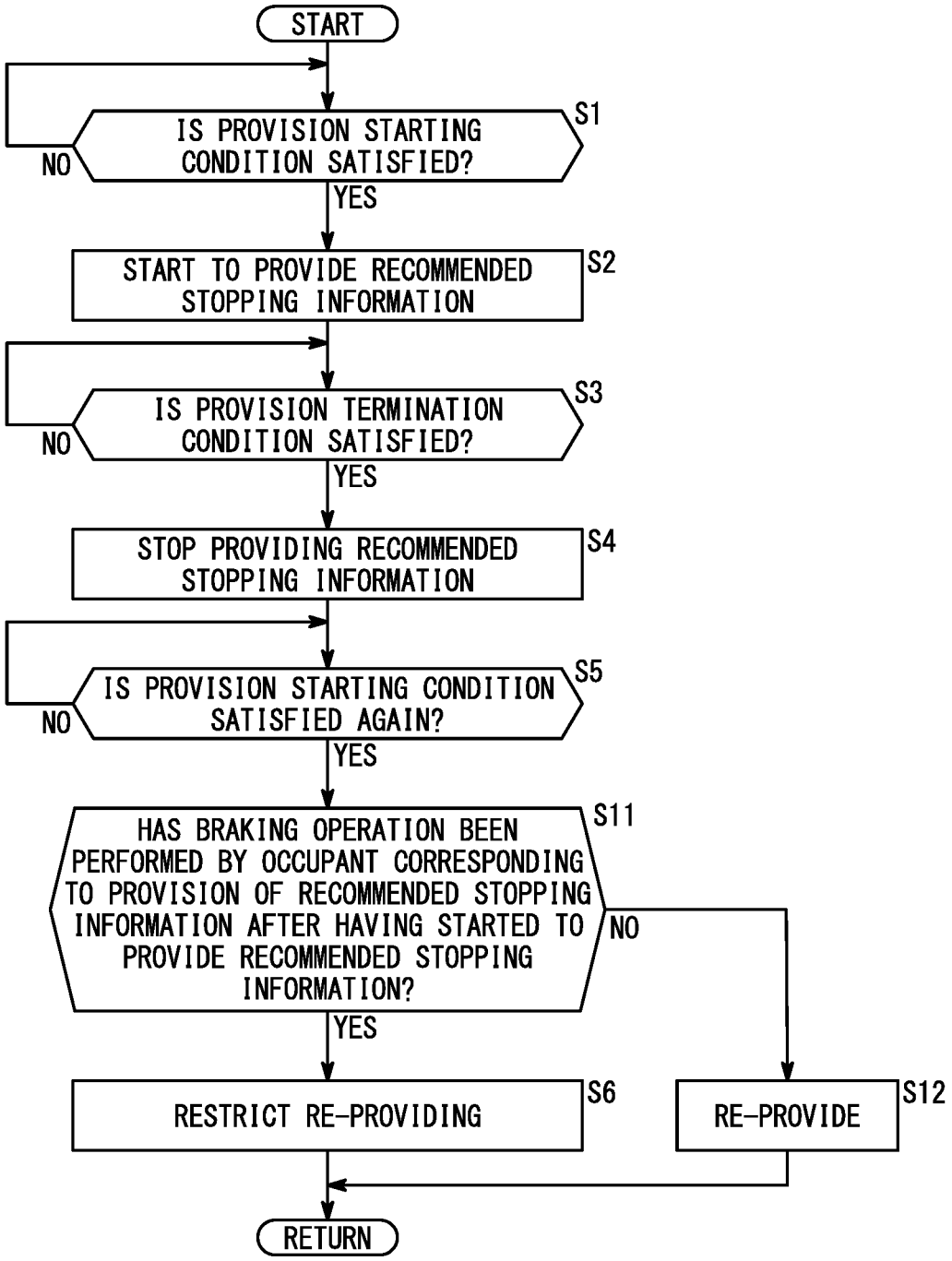
FIG. 4 is a flowchart illustrating an example of operations of the information providing device according to a first modification.

An example of operations of the information providing device according to the present modification will be described with reference to FIG. 4. FIG. 4 is a flowchart illustrating an example of operations of the information providing device according to the present modification.

Steps S1 to S5 are the same as steps S1 to S5 described above with reference to FIG. 3, and therefore, description of these steps is omitted. In the case that the provision starting condition is satisfied again (YES in step S5), the process transitions to step S11. In the case that the provision starting condition is not satisfied again (NO in step S5), step S5 is repeated.

In step S11, the information providing control unit 62 determines whether or not the braking operation has been performed by the occupant corresponding to the provision of the recommended stopping information after having started to provide the recommended stopping information. In the case that the braking operation is performed by the occupant corresponding to the provision of the recommended stopping information after having started to provide the recommended stopping information (YES in step S11), the process transitions to step S6. In the case that the braking operation is not performed by the occupant corresponding to the provision of the recommended stopping information after having started to provide the recommended stopping information (NO in step S11), the process transitions to step S12.

In step S12, the information providing control unit 62 re-provides the recommended stopping information. More specifically, the information providing control unit 62 resumes providing the recommended stopping information using the speaker 46. Moreover, the display of the recommended stopping information on the display unit 40 can be maintained as it is. Thereafter, the processes of step S3 and the subsequent steps are repeated.

Step S6 is the same as step S6 described above with reference to FIG. 3, and therefore, description of this step is omitted. In the foregoing manner, the process shown in FIG. 4 is carried out.

In the foregoing manner, in the case that the braking operation is not performed by the occupant corresponding to the provision of the recommended stopping information after having started to provide the recommended stopping information, the information providing control unit 62 need not restrict the re-providing of the recommended stopping information.

(Second Modification)

An information providing device, a movable body, and an information providing method according to a second modification of the present embodiment will be described with reference to the drawings.

According to the present modification, in the case that the speed of the movable body 10 after having started to provide the recommended stopping information has become less than a third speed threshold value TH3 which is lower than the second speed threshold value TH2, the information providing control unit 62 does not restrict the re-providing of the recommended stopping information. The third speed threshold value TH3 is a speed value for determining whether or not the movable body 10 has come to a stop, and can be set, for example, to a value less than 5 km/h. More specifically, in the case that the movable body 10 has come to a stop after having started to provide the recommended stopping information, the control is reset.

Figure 5:
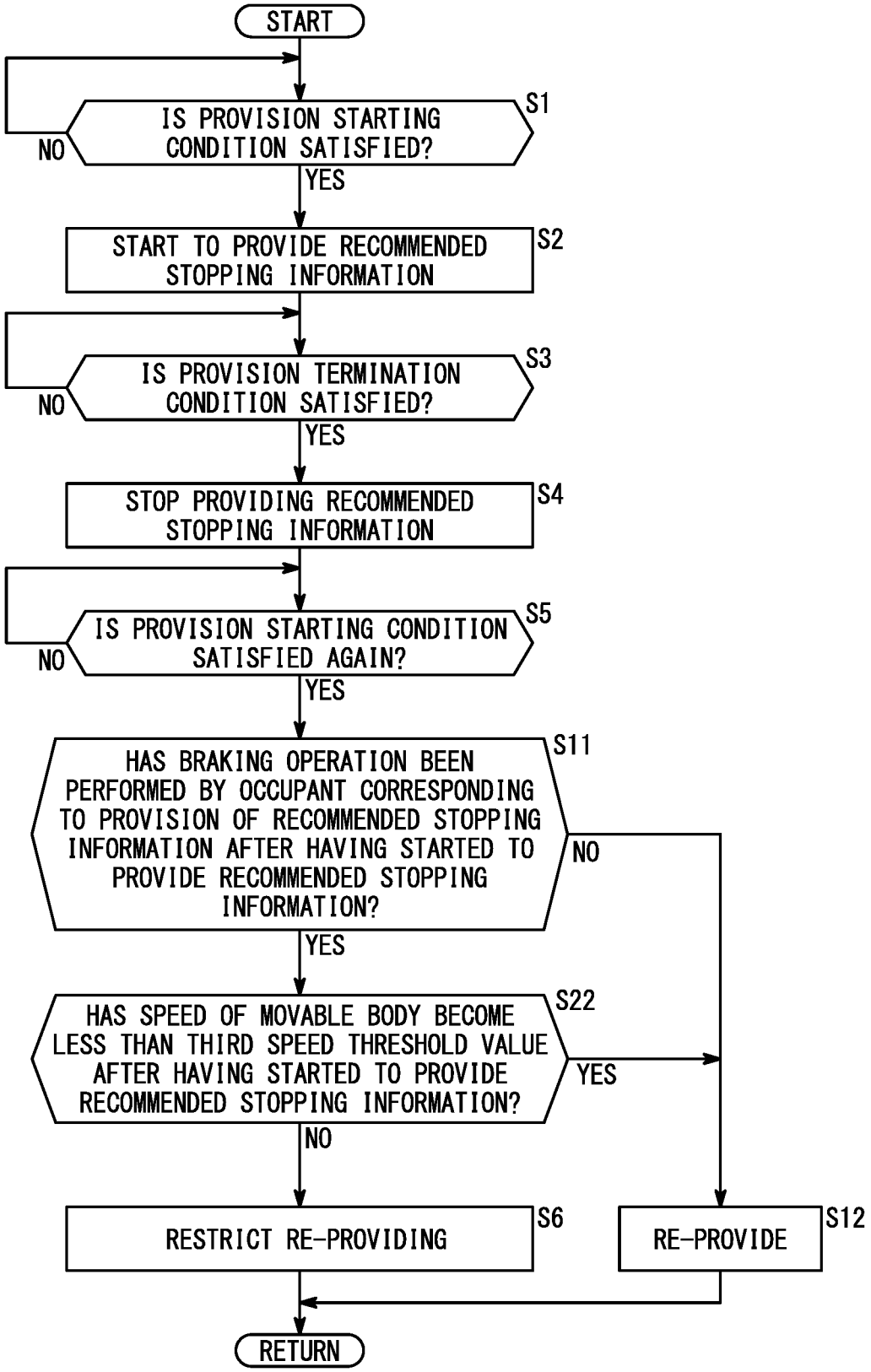
FIG. 5 is a flowchart illustrating an example of operations of the information providing device according to a second modification.

An example of operations of the information providing device according to the present modification will be described with reference to FIG. 5. FIG. 5 is a flowchart illustrating an example of operations of the information providing device according to the present modification.

Steps S1 to S5 are the same as steps S1 to S5 described above with reference to FIG. 3, and therefore, description of these steps is omitted. In the case that the provision starting condition is satisfied again (YES in step S5), the process transitions to step S11. In the case that the provision starting condition is not satisfied again (NO in step S5), step S5 is repeated.

Step S11 is the same as step S11 described above with reference to FIG. 4, and therefore, description of this step is omitted. In the case that the braking operation is performed by the occupant corresponding to the provision of the recommended stopping information after having started to provide the recommended stopping information (YES in step S11), the process transitions to step S22. In the case that the braking operation is not performed by the occupant corresponding to the provision of the recommended stopping information after having started to provide the recommended stopping information (NO in step S11), the process transitions to step S12.

In step S22, the information providing control unit 62 determines whether or not the speed of the movable body 10 has become less than the third speed threshold value TH3 after having started to provide the recommended stopping information. If the speed of the movable body 10 has become less than the third speed threshold value TH3 after having started to provide the recommended stopping information (YES in step S22), the process transitions to step S12. If the speed of the movable body 10 has not become less than the third speed threshold value TH3 after having started to provide the recommended stopping information (NO in step S22), the process transitions to step S6.

Step S6 is the same as step S6 described above with reference to FIG. 3, and therefore, description of this step is omitted. Step S12 is the same as step S12 described above with reference to FIG. 4, and therefore, description of this step is omitted. In the foregoing manner, the process shown in FIG. 5 is carried out.

In the foregoing manner, in the case that the speed of the movable body 10 after having started to provide the recommended stopping information has become less than the third speed threshold value TH3 which is lower than the second speed threshold value TH2, the information providing control unit 62 need not restrict the re-providing of the recommended stopping information.

Modified Embodiment

Although preferred embodiments of the present invention have been described above, the present invention is not limited to the above-described embodiments, and various modifications can be made thereto without departing from the essence and gist of the present invention.

For example, when the movable body 10 is traveling in the lane 80C, in the case that, after the provision of the recommended information has been initiated, a lane change to the lane 80R is carried out in order to make a right turn, and an arrow permitting the right turn is being displayed by the traffic signal 72, the information providing control unit 62 can perform the following control. More specifically, in such a case, the information providing control unit 62 stops providing the recommended stopping information using the speaker 46. In this case, the information providing control unit 62 continues to display the recommended stopping information on the display unit 40. Thereafter, in the case that a lane change is carried out again, and the movable body 10 is placed in a state of traveling in the lane 80C, the information providing control unit 62 restricts the provision of the recommended stopping information using the speaker 46. More specifically, even in the case that the provision starting condition is satisfied, the information providing control unit 62 does not provide the recommended stopping information using the speaker 46.

Summarizing the above-described embodiment and the modifications thereof, the characteristic features described below are realized.

The information providing device (12) includes the external environment recognition unit (58) that recognizes the external environment of the movable body (10), the travel state determination unit (60) that determines the travel state of the movable body, and the information providing control unit (62) that, in the case that the provision starting condition for starting to provide the recommended stopping information is satisfied by the current indication of the traffic signal (72) recognized by the external environment recognition unit, and the travel state determined by the travel state determination unit, initiates the provision of the recommended stopping information, and in the case that the provision termination condition for stopping to provide the recommended stopping information is satisfied, terminates the provision of the recommended stopping information, wherein, after the provision of the recommended stopping information is initiated by having satisfied the provision starting condition, in the case that the provision of the recommended stopping information is terminated by having satisfied the provision termination condition, and further thereafter, the provision starting condition is satisfied again, the information providing control unit restricts the re-providing of the recommended stopping information. In accordance with such a configuration, in the case that the provision starting condition for starting to provide the recommended stopping information is satisfied by the current indication of the traffic signal and the travel state of the movable body, the provision of the recommended stopping information is initiated. After the provision of the recommended stopping information is initiated, in the case that the provision of the recommended stopping information is terminated due to having satisfied the provision termination condition, and further thereafter, the provision starting condition is satisfied again, re-providing of the recommended stopping information is restricted. That is, in accordance with such a configuration, since re-providing of the recommended stopping information is restricted, it is possible to prevent a situation in which the occupant is made to feel irritated. Accordingly, the information providing device can be provided which is capable of accurately providing the recommended stopping information.

The provision starting condition may be a condition in which the current indication of the traffic signal recognized by the external environment recognition unit is an indication to stop, and the speed of the movable body determined by the travel state determination unit is greater than or equal to the first speed threshold value (TH1).

The provision termination condition may be a condition in which the speed of the movable body determined by the travel state determination unit is less than the second speed threshold value (TH2) which is lower than the first speed threshold value.

In the case that the speed of the movable body after having started to provide the recommended stopping information has become less than the third speed threshold value which is lower than the second speed threshold value, the information providing control unit need not restrict the re-providing of the recommended stopping information.

The information providing control unit may provide the recommended stopping information using the speaker (46) provided in the movable body, and the display unit (40) provided in the movable body, and the information providing control unit may restrict the re-providing of the recommended stopping information using the speaker, while on the other hand, may continue to provide the recommended stopping information using the display unit even when the provision termination condition is satisfied.

There may further be provided the operation determination unit (64) that determines whether or not a braking operation has been performed by the occupant of the movable body, and in the case that the braking operation corresponding to the provision of the recommended stopping information is not performed by the occupant after the provision of the recommended stopping information has been initiated, the information providing control unit need not restrict the re-providing of the recommended stopping information.

The movable body is equipped with the information providing device as described above.

The method of providing information includes the step (step S1, step S2) of initiating the provision of the recommended stopping information, in the case that the provision starting condition for starting to provide the recommended stopping information is satisfied by the current indication of the traffic signal and the travel state of the movable body, and the step (step S3, step S4) of terminating the provision of the recommended stopping information, in the case that the provision termination condition for stopping to provide the recommended stopping information is satisfied, wherein, after the provision of the recommended stopping information is initiated by having satisfied the provision starting condition, in the case that the provision of the recommended stopping information is terminated by having satisfied the provision termination condition, and further thereafter, the provision starting condition is satisfied again, re-providing of the recommended stopping information is restricted (step S6).

What is claimed is:

1. An information providing device comprising at least one processor configured to execute computer executable commands stored in a memory, wherein the at least one processor executes the computer executable commands to cause the information providing device to:

recognize an external environmental situation of a movable body;

determine a travel state of the movable body;

in a case that a provision starting condition for starting to provide recommended stopping information is satisfied by a current indication of a recognized traffic signal, and the determined travel state, initiate provision of the recommended stopping information, and in a case that a provision termination condition for stopping to provide the recommended stopping information is satisfied, terminate the provision of the recommended stopping information; and after the provision of the recommended stopping information is initiated by having satisfied the provision starting condition, in a case that the provision of the recommended stopping information is terminated by having satisfied the provision termination condition, and further thereafter, the provision starting condition is satisfied again, restrict re-providing of the recommended stopping information.

2. The information providing device according to claim 1, wherein the provision starting condition is a condition in which the recognized current indication of the traffic signal is an indication to stop, and a speed of the determined movable body is greater than or equal to a first speed threshold value.

3. The information providing device according to claim 2, wherein the provision termination condition is a condition in which the speed of the determined movable body is less than a second speed threshold value which is lower than the first speed threshold value.

4. The information providing device according to claim 3, wherein, in a case that the speed of the movable body after the provision of the recommended stopping information has been started has become less than a third speed threshold value which is lower than the second speed threshold value, the at least one processor causes the information providing device not to restrict the re-providing of the recommended stopping information.

5. The information providing device according to claim 1, wherein:

the at least one processor causes the information providing device to provide the recommended stopping information using a speaker provided in the movable body, and a display unit provided in the movable body; and the at least one processor causes the information providing device to restrict the re-providing of the recommended stopping information using the speaker, and causes the information providing device to continue to provide the recommended stopping information using the display unit even when the provision termination condition is satisfied.

6. The information providing device according to claim 1, wherein:

the at least one processor causes the information providing device to determine whether or not a braking operation has been performed by an occupant of the movable body; and in a case that the braking operation corresponding to the provision of the recommended stopping information is not performed by the occupant after the provision of the recommended stopping information has been initiated, the at least one processor causes the information providing device not to restrict the re-providing of the recommended stopping information.

7. A movable body comprising an information providing device, the information providing device comprising at least one processor configured to execute computer executable commands stored in a memory, wherein the at least one processor executes the computer executable commands to cause the information providing device to:

recognize an external environmental situation of a movable body;

determine a travel state of the movable body;

in a case that a provision starting condition for starting to provide recommended stopping information is satisfied by a current indication of a recognized traffic signal, and the determined travel state, initiate provision of the recommended stopping information, and in a case that a provision termination condition for stopping to provide the recommended stopping information is satisfied, terminate the provision of the recommended stopping information; and after the provision of the recommended stopping information is initiated by having satisfied the provision starting condition, in a case that the provision of the recommended stopping information is terminated by having satisfied the provision termination condition, and further thereafter, the provision starting condition is satisfied again, restrict re-providing of the recommended stopping information.

8. A method of providing information, comprising:

initiating a provision of recommended stopping information, in a case that a provision starting condition for starting to provide the recommended stopping information is satisfied by a current indication of a traffic signal and a travel state of a movable body; and terminating the provision of the recommended stopping information, in a case that a provision termination condition for stopping to provide the recommended stopping information is satisfied;

wherein, after the provision of the recommended stopping information is initiated by having satisfied the provision starting condition, in a case that the provision of the recommended stopping information is terminated by having satisfied the provision termination condition, and further thereafter, the provision starting condition is satisfied again, re-providing of the recommended stopping information is restricted.

* * * * *